United States Patent [19]

Hayden

[11] Patent Number: 4,947,490

[45] Date of Patent: Aug. 14, 1990

[54] FOOTBALL HELMET WITH BREAKAWAY FACE MASK

[76] Inventor: James T. Hayden, 3154 Exon St., Cincinnati, Ohio 45241

[21] Appl. No.: 351,935

[22] Filed: May 15, 1989

[51] Int. Cl.[5] ..... A42B 3/20

[52] U.S. Cl. ..... 2/424; 2/425; 2/9

[58] Field of Search ..... 2/9, 206, 411, 422, 2/424, 425

[56] References Cited

U.S. PATENT DOCUMENTS

| | | | |
|---|---|---|---|
| 2,986,739 | 6/1961 | Rozzi, Sr. | 2/9 |
| 3,283,336 | 11/1966 | Critser | 2/9 |
| 3,889,296 | 6/1975 | Martin | 2/9 |
| 4,233,687 | 11/1980 | Lancellotti | 2/9 |
| 4,271,537 | 6/1981 | Bowlus et al. | 2/424 |
| 4,363,140 | 12/1982 | Correale | 2/9 |
| 4,774,729 | 10/1988 | Coates et al. | 2/424 |
| 4,885,807 | 12/1989 | Snow, Jr. | 2/424 |

*Primary Examiner*—Werner H. Schroeder
*Assistant Examiner*—Michael A. Neas
*Attorney, Agent, or Firm*—Wood, Herron & Evans

[57] ABSTRACT

A football helmet is provided with a releasable face mask which is attached to the helmet by hook-and-pile fastening means. Abutment means prevent relative movement of the face mask in response to a force which impinges on the mask in a direction toward the wearer's face, but permit the mask to break away from the helmet in response to excessive forces in other directions, as when the mask is pulled forward or twisted sideways.

9 Claims, 2 Drawing Sheets

FOOTBALL HELMET WITH BREAKAWAY FACE MASK

FIELD OF THE INVENTION

This invention relates to protective athletic headgear, and more particularly to a football helmet.

BACKGROUND

The conventional face masks on football helmets provide good protection against injury to the mouth, teeth and nose of the wearer. Ironically, however, they do create some risk of injury to the wearer's neck: if another player grips the mask and jerks it abruptly, the mask can act as a lever to increase the twisting force on the neck, and thereby can cause an injury which might not otherwise occur, or can increase its seriousness. (For this reason the penalty in football for a "face mask" violation is a relatively severe assessment of 15 yards.)

THE PRIOR ART

The prior art has recognized this risk of injury from face masks, and discloses various attempts to provide face masks which will "break away" or release from the helmet if they are jerked or twisted abruptly to one side or the other. Rozzi U.S. Pat. No. 2,986,739 shows a face mask which is secured on a helmet by a resilient connector that includes a spring clip arrangement which releasably grasps terminal ends of the mask. Critser U.S. Pat. No. 3,283,336 uses a detent mechanism to grasp annular grooves near the terminal ends of the mask, the ends being inserted in mounting brackets which include the detent mechanism. The detents release the mask under a forward pull. Martin U.S. Pat. No. 3,889,296 also uses a detent, and further includes a stabilizing nose-protecting strut. Lancellotti U.S. Pat. No. 4,233,687 shows a face mask having a snap connection to mounting blocks on the side of the helmet, and which releases when pulled. In Bowlus U.S. Pat. No. 4,271,537, the mask is attached by a resilient U-shaped connector which releases on predetermined outward pull. Correale U.S. Pat. No. 4,363,140 uses attaching blocks having spring clips with protective covers.

SUMMARY OF INVENTION

In accordance with this invention, a helmet is provided with a face mask which provides the usual protective capabilities in response to force applied in the direction toward the player's face, but which will release from its connection to the helmet when excessive force (e.g., force sufficient to hyperextend the neck) is applied in other directions. This result is achieved without the use of clamps, springs or detents between the face mask and the helmet (which could themselves be a source of injury) by a simple, compact, and resilient attachment mechanism. The attachment is provided by a "hook-and-pile" type connection of the mask to the helmet, together with fixed stops on the helmet which abut portions of the face mask and prevent the mask from releasing in response to a force having a component in the direction toward the wearer's face, but which permit the hook-and-pile connection to separate in response to an excessive force in a forward or sideways direction, as when it is twisted or jerked. The hook-and-pile means are sized to hold the mask securely under ordinary forward impact, but to release if the load in other directions exceeds a predetermined amount. (The minimum force effective to cause release is referred to herein as an "excessive force.")

DESCRIPTION OF THE DRAWINGS

The invention can best be described by reference to the accompanying drawings, in which.

DETAILED DESCRIPTION

Figure 1:
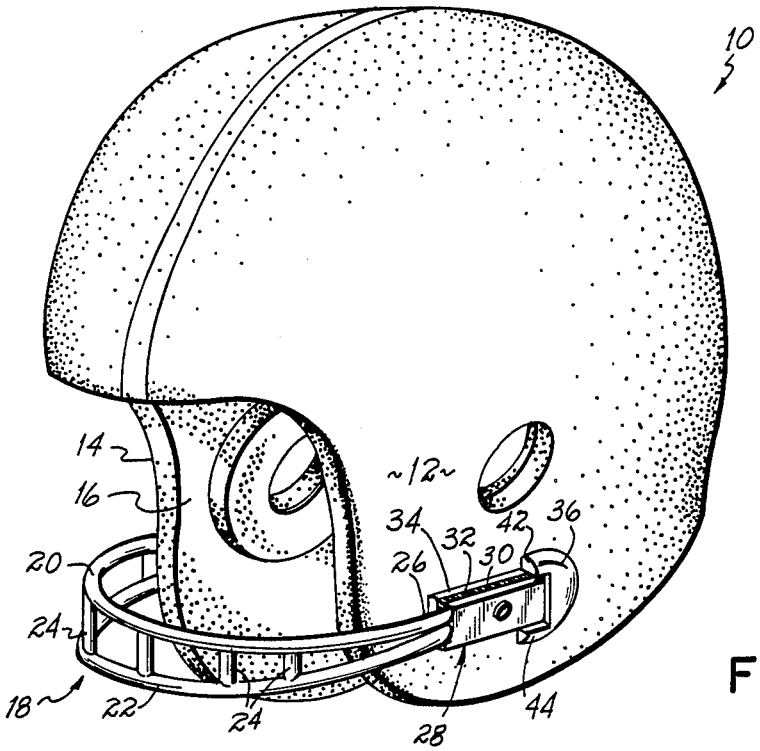
FIG. 1 is a perspective view of a helmet having a releasable mask in accordance with a first embodiment of the invention.

In the drawings, the football helmet designated generally by 10 has opposite sides 12 and 14 which cover the ears of the wearer, a frontal opening 16, and a face mask 18 over opening 16. The helmet and mask may be conventional in overall construction with the exception of the releasable face mask attaching means described below. It is contemplated that these attaching means can be retro-fitted to existing helmets.

Figure 2:
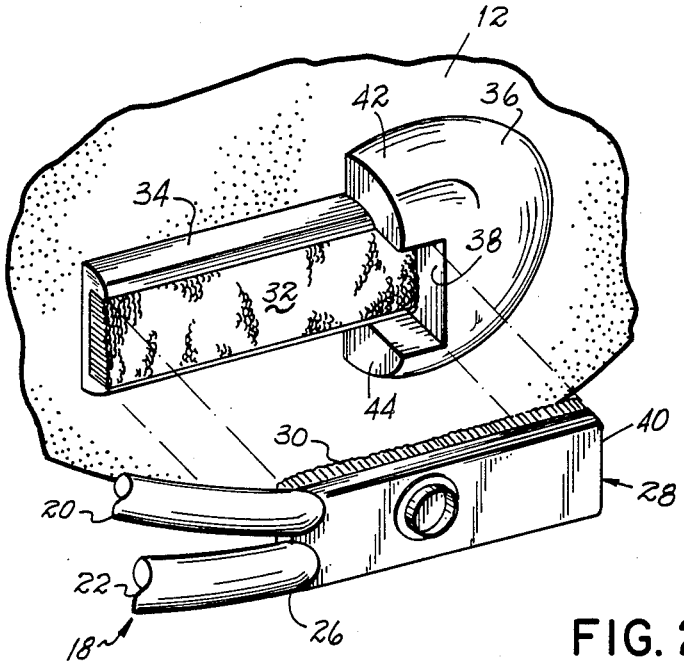
FIG. 2 is an exploded, enlarged view, partly broken away, showing the manner in which ends of the face mask of FIG. 1 are releasably connectable to the helmet.

The particular face mask 18 of the embodiment shown in FIGS. 1 and 2 comprises two spaced bars 20 and 22 which are interconnected by spaced vertical posts 24. The bars 20 and 22 converge at their rearward ends, one end 26 being shown in the drawings. The face mask includes two attaching portions which are releasably attached to the helmet by mating hook-and-pile type interengaging means, as described in greater detail below.

Hook-and-pile fastening materials are available commercially under various trademarks such as "Velcro" and "Scotchmate." They comprise two mating portions, one of which has a plurality of tiny resilient loops, the other of which has a plurality of resilient hooks which readily engage with the loops to make a releasable connection between the two portions.

To provide this connection, an attachment plate 28 is secured to the face mask bars 20 and 22 inside each end 26 thereof. The plate has an inside face to which one portion 30 of mating hook-and-pile attaching means is mounted. The hook-and-pile portion 30 cooperates with a cooperating portion 32 which is preferably presented on a seat 34 secured on the side 12 of the helmet. Seat 34, in this embodiment, is in the form of a channel-shaped extrusion having a recessed center in which the cooperating hook-and-pile portion 32 is secured and confined against twist-off. The seat can for example be made of polyurethane or aluminum.

The particular hook-and-pile material which is presently preferred for use in this invention, is "Scotchmate" brand material, type 170/400, which is supplied by Minnesota Mining and Manufacturing Co. This material (both mating portions) is supplied in strips and can be cut to desired lengths and/or widths for attachment to the attachment plate 28 and the seat 34.

Rearwardly of the seat on each side is a stop or abutment 36 which may be of rounded U-shaped configuration as shown in FIGS. 1 and 2. The abutment presents a forwardly facing surface 38 which physically abuts the rear end 40 of the face mask attachment plate 28 so as to positively prevent the latter from being moved rearwardly, past surface 38. The abutment 36 preferably has forwardly extending arms 42 and 44 which project forward just above and below the attachment plate, thereby preventing the attachment plate from being easily twisted or jerked upwardly or downwardly relative to its attachment to seat 34. Seat 34 and abutment 36 may be secured to the helmet by epoxy, cement, rivets or screws. It can be seen that abutment 36 prevents movement of the face mask toward the face opening, and thereby provides protection of the wearer, but does not prevent movement of the mask away from the frontal opening in response to an excessive twisting or jerking force with a component in a forward direction (such as an illegal grabbing and yanking of the face mask), of magnitude sufficient to overcome the interengagement between the mating hook-and-pile portions 30 and 32.

Figure 3:
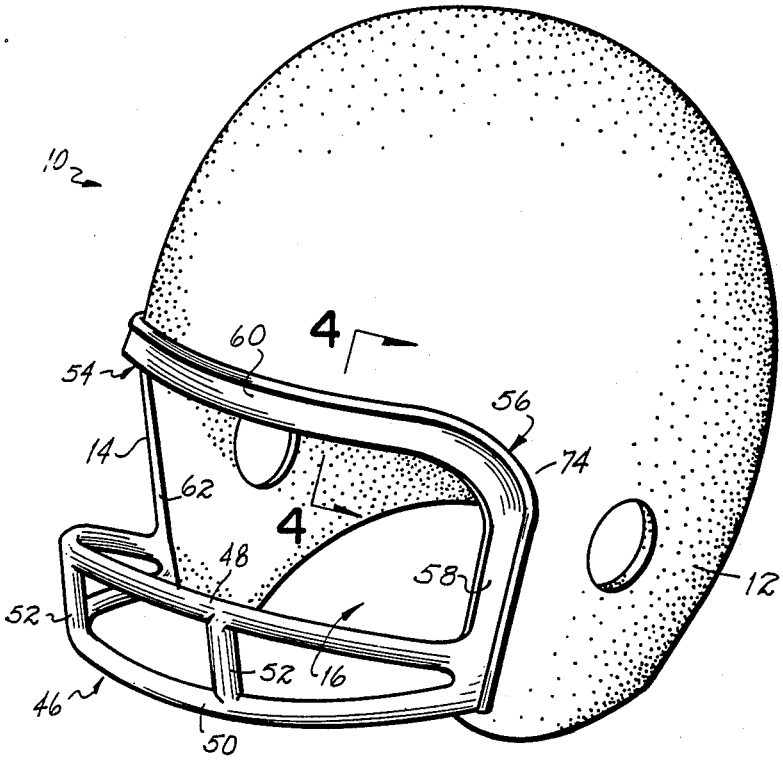
FIG. 3 is a perspective view of the presently preferred form of helmet and releasable mask.
Figure 4:
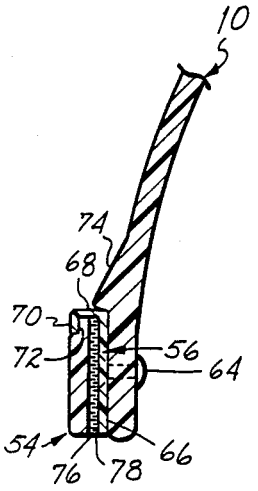
FIG. 4 is an enlarged fragmentary cross-sectional view taken on line 4-4 of FIG. 3.

In the embodiment described above the face mask is attached to the helmet at two opposite rearwardly extending ends. FIGS. 3 and 4 show another embodiment, which is presently preferred, wherein a face mask 46 is attached to the helmet along both sides and across the top of the helmet face opening 16.

In this embodiment mask 46 comprises two spaced bars 48 and 50 which are interconnected by spaced posts 52. The bars 48 and 50 meet and are integrally joined to an attachment portion in the form of a helmet-engaging rail 54. This rail 54 is contoured to match the contour of the helmet around face opening 16, and is releasably engageable with and seatable in a rail seat 56 which is secured to the helmet along the face opening, preferably continuously up one side 58 of the face opening, across the front top 60 of the opening, and down the other side 62 thereof. As shown in FIG. 4, rail 54 seats rearwardly and upwardly in rail seat 56 around the face opening. Rail seat 56 may be secured to the helmet 12 by spaced fasteners such as rivets, one of which is designated by 64. Seat 56 is preferably of L-shaped cross-sectional configuration, with a base 66 and an outwardly projecting peripheral arm or rib 68. Arm 68 projects at approximately a right angle to the surface of the helmet. Rail 54 seats in the angle between the base 66 and arm 68 of rail seat 56.

It is further preferred that a return or lip 70 project from the outer edge of arm 68. Lip 70 engages in a rabbit or recess 72 on chair rail 54 and further improves the resistance of the face mask to undesired release. Preferably rail seat 56 itself resides against and is backed up by a molded annular abutment 74 molded around the helmet face opening (see FIG. 4). Mating halves 76, 78 of a hook-and-pile type fastener are provided on the respective opposed faces of the seat base 66 and rail 54.

The embodiment shown in FIGS. 3 and 4 provides a greater degree of protection and resistance to blows toward the head, than the embodiment of FIGS. 1 and 2. Moreover, it is somewhat cleaner in that side seats 36, rearward of the face opening, are not provided. As in the other embodiment, however, if the bars of the face mask are gripped and jerked forwardly, the interconnection will be released from the helmet.

Hook-and-pile materials are available in different degrees of adhesion or releasability. The degree of force at which a given face mask attachment will release depends not only on the particular brand and model of hook-and-pile material used, but also on the area, shape and positions of attaching means, and the leverage and direction of separating force which is applied. Hook-and-pile fasteners are conventionally separated by a "peeling" motion, in which the separating force is perpendicular to their areas. Here, however, the mask is constrained to separate initially by a shear force which acts parallel to the plane of the fastener, rather than being peeled away. (However, after the connection on one part of the helmet has separated, the face mask may swing around or pivot to release by peeling of other parts of the helmet.) It is contemplated that the force at which the face mask will release in response to a sidewise twist can be controlled by selection of the particular material used and the area of the facially engaging portions, the disengaging force increasing rapidly with increasing surface area. Attachment means which require stronger forces for release should be provided in helmets for stronger and older players. The invention is expected to be most useful for younger players (junior high school and high school), and for these uses the areas required are quite small.

Having described the invention, what is claimed is:

1. A helmet having a breakaway face mask, said helmet having opposite sides, a frontal opening in which the face of a wearer is exposed in use, and a face mask protectively covering at least a portion of said frontal opening, said face mask having at least one attaching portion with means for releasably mounting said attaching portion to said helmet, said mounting means comprising mating hook-and-pile interengaging means located on the helmet and on the attaching portion of the mask, said helmet having an abutment located rearwardly of said attaching portion, said abutment positively preventing the attaching portion of the face mask from moving rearwardly past said abutment in response to a force on said mask, the strength of interengagement between the respective mating hook-and-pile means being such that an excessive force, applied from said mask through said attaching portion, which force is not directed toward said abutment will overcome the interengagement of the hook-and-pile means and thereby release the attaching portion from the helmet.

2. The helmet of claim 1 further wherein said helmet has a seat on each side of said opening and each attaching portion of said face mask has an attachment plate, the mating hook-and-pile means comprising cooperating portions on said seat and the respective attachment plate.

3. The helmet of claim 2 wherein said seat is provided by a channel attached to said helmet, and one portion of said hook-and-pile means is confined in said channel.

4. The helmet of claim 2 further wherein said abutment is integrally connected to the respective seat.

5. The helmet of claim 4 wherein said abutment is U-shaped, having arms which project forwardly above and below the seat, said arms restricting release of said mask in response to forces directed upwardly or downwardly relative to the helmet.

6. The helmet of claim 1 further wherein said helmet includes a rail seat which extends along the edge of said face opening, and said attaching portion of said mask comprises a rail which is configured to sit against said seat along the edge of said face opening, said hook-and-pile inter-engaging means being secured respectively to and between said rail and said seat.

7. The helmet of claim 6 wherein said rail seat includes a base and an arm which extends outwardly at substantially a right angle to said base, and said rail seats against and is restrained by said base and said arm.

8. The helmet of claim 7 further wherein a lip projects from said arm, parallel to said base, and said rail is engageable between said lip and base.

9. The helmet of claim 1 wherein said abutment is molded integrally into said helmet, and said seat is positioned adjacent to and forwardly of said abutment.

* * * * *